US008359677B1

(12) United States Patent
Mock

(10) Patent No.: US 8,359,677 B1
(45) Date of Patent: Jan. 29, 2013

(54) ASSEMBLY FOR DELAYED LOWERING OF A RAISED TOILET SEAT

(76) Inventor: Craig C. Mock, Dodge City, KS (US)

( * ) Notice: Subject to any disclaimer, the term of this patent is extended or adjusted under 35 U.S.C. 154(b) by 349 days.

(21) Appl. No.: 12/875,751

(22) Filed: Sep. 3, 2010

(51) Int. Cl.
*A47K 13/10* (2006.01)

(52) U.S. Cl. ..... 4/246.1; 4/248

(58) Field of Classification Search ..... 4/246.1, 4/248

See application file for complete search history.

(56) References Cited

U.S. PATENT DOCUMENTS

| | | | | |
|---|---|---|---|---|
| 2,591,476 | A | 4/1952 | Swanson | |
| 3,447,199 | A | 6/1969 | Trimble | |
| 4,722,946 | A | 2/1988 | Hostetler | |
| 5,049,591 | A | 9/1991 | Hayashi et al. | |
| 5,193,228 | A | 3/1993 | Murasawa et al. | |
| 5,279,000 | A * | 1/1994 | Mercier et al. | 4/240 |
| 5,388,281 | A * | 2/1995 | Wiklund et al. | 4/248 |
| 5,765,263 | A | 6/1998 | Bolinas et al. | |
| 5,996,132 | A | 12/1999 | Sorimachi | |
| 6,000,069 | A | 12/1999 | Sorimachi | |
| 6,178,597 | B1 | 1/2001 | Suzuki et al. | |
| 6,178,598 | B1 | 1/2001 | Creely et al. | |
| 6,182,301 | B1 * | 2/2001 | Krueger et al. | 4/248 |
| 6,230,335 | B1 | 5/2001 | Miller | |
| 6,237,173 | B1 | 5/2001 | Schlichter et al. | |
| 6,364,360 | B1 | 4/2002 | Kaufman | |
| 6,421,842 | B1 | 7/2002 | Fujita | |
| 6,817,441 | B2 | 11/2004 | Murakami et al. | |
| 2001/0004776 | A1 | 6/2001 | Fujita | |
| 2006/0156458 | A1 | 7/2006 | Myers | |
| 2009/0036563 | A1 | 2/2009 | Tai et al. | |
| 2009/0106884 | A1 | 4/2009 | Bemis et al. | |

FOREIGN PATENT DOCUMENTS

| | | |
|---|---|---|
| JP | 2006/144876 | 6/2006 |

* cited by examiner

*Primary Examiner* — Huyen Le
(74) *Attorney, Agent, or Firm* — Kenneth H. Jack; Davis & Jack, LLC

(57) ABSTRACT

An assembly for pivotally lowering a raised toilet seat including a chamber having an interior foam compression wall; a compression plate received within the chamber, the compression plate being movable between a foam compressing position and an expanded foam position; a piece of viscoelastic polyurethane foam received within the chamber, the piece of viscoelastic polyurethane foam being positioned between the compression plate and the foam compression wall; and a linking hinge axle assembly interconnecting the toilet seat and the compression plate, the hinge axle assembly being adapted for positioning the compression plate at the foam compressing position while the toilet's seat is pivotally raised, and for delayed lowering of the seat upon foam expansion impelled movement of the compression plate to its expanded foam position.

14 Claims, 3 Drawing Sheets

ASSEMBLY FOR DELAYED LOWERING OF A RAISED TOILET SEAT

FIELD OF THE INVENTION

This invention relates to toilets and toilet seats. More particularly, this invention relates to hinge assemblies which interconnect toilet seats and toilets.

BACKGROUND OF THE INVENTION

Residents of households often find it desirable that the hinged and pivoting seats of toilets within the household normally remain in their "down" or lowered positions. Males within such households often find it desirable to pivotally move such toilet seats to their "up" or pivotally raised positions immediately prior to use and to pivotally lower such seats to their down positions immediately after use. However, in many circumstances, male users forget to perform such toilet seat lowering step, undesirably leaving such toilet seat upwardly displaced, and away from its desirable and normal down position.

The instant inventive assembly for delayed lowering of a raised toilet seat solves or ameliorates the problems and deficiencies discussed above by incorporating within a toilet seat's hinge structure pieces of viscoelastic polyurethane foam or "memory foam" and by arranging those foam pieces so that raising of the toilet seat performs a foam compressing function, and so that the foam's subsequent expansion toward its "memory" configuration performs a delayed toilet seat lowering function.

BRIEF SUMMARY OF THE INVENTION

A first structural component of instant inventive assembly for delayed lowering a raised toilet seat comprises a hollow chamber which is preferably cylindrical and is composed of durable and corrosion resistant plastic or stainless steel. In a preferred embodiment, the chamber receives and supports at least a first foam compression wall, and preferably a pair of such compression walls are received and supported within the chamber.

A further structural component of the instant inventive assembly comprises at least a first, and preferably a pair of compression plates. Each compression plate is preferably received within the chamber and is mounted for orbital and pivoting movement between foam compressing positions and expanded foam positions.

A further structural component of the instant inventive assembly comprises at least a first piece of viscoelastic polyurethane foam. Preferably two, or a pair, of foam pieces are provided. Where a pair of viscoelastic polyurethane foam pieces are provided, they are preferably received within the chamber, and are situated between the chamber's foam compression walls and compression plates for alternative plate induced compressions of the viscoelastic polyurethane foam pieces and rebounding plate driving expansions of the viscoelastic polyurethane foam pieces.

A further structural component of the instant inventive assembly comprises linking means which operatively interconnect the toilet seat and the at least first or pair of compression plates. In a preferred embodiment, the linking means are adapted for positioning the at least first or pair of compression plates at their foam compression positions while the toilet seat is pivotally raised, and the linking means are further adapted for pivotally lowering said seat upon movement of the at least first or pair of compression plates to their expanded foam positions. In the preferred embodiment, such seat lowering action is induced by the inherent delayed or slowed expansions of the pieces of viscoelastic polyurethane foam from their compressed forms to their expanded memory configurations.

In a preferred embodiment of the instant inventive assembly, the linking means comprise a pivot axle which is supported within and extends in the left to right direction through the chamber, such axle being rigidly connected both to the toilet seat and the compression plates.

In use of the instant inventive assembly for delayed lowering of a raised toilet seat, the toilet seat may initially be at rest at its lowered position. Thereafter, a male user of the instant inventive assembly may manually pivotally raise the toilet seat. Upon so raising the toilet seat, the assembly's compression plates pivotally and orbitally move within the chamber from their expanded foam positions to their foam compressing positions, such motions compressing the pieces of viscoelastic polyurethane foam between the compression plates and the chamber's compression walls.

Thereafter, the male user may release the toilet seat, allowing the pieces of viscoelastic polyurethane foam to commence their slowed and inherently delayed expansions toward their memory positions.

In the preferred embodiment of the instant invention, the slow recovery character of the pieces of viscoelastic polyurethane foam advantageously mechanically translates into a slowed and delayed toilet seat counter-pivoting and lowering motion. The slowed viscoelastic polyurethane foam expansion response time advantageously allows for a male user's commencement and completion of use of a toilet equipped with the inventive assembly during the time period (i.e., a seat lowering delay time) existing between such user's release of the raised toilet seat and the foam's delayed response in lowering the toilet seat.

Accordingly, it is an object of the instant invention to provide an assembly for delayed lowering of a raised toilet seat which incorporates structures, as described above, and which arranges those structures in relationships with each other, as described above, and in manners described above, for the performance and achievement of beneficial objectives and advantages, as described above.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
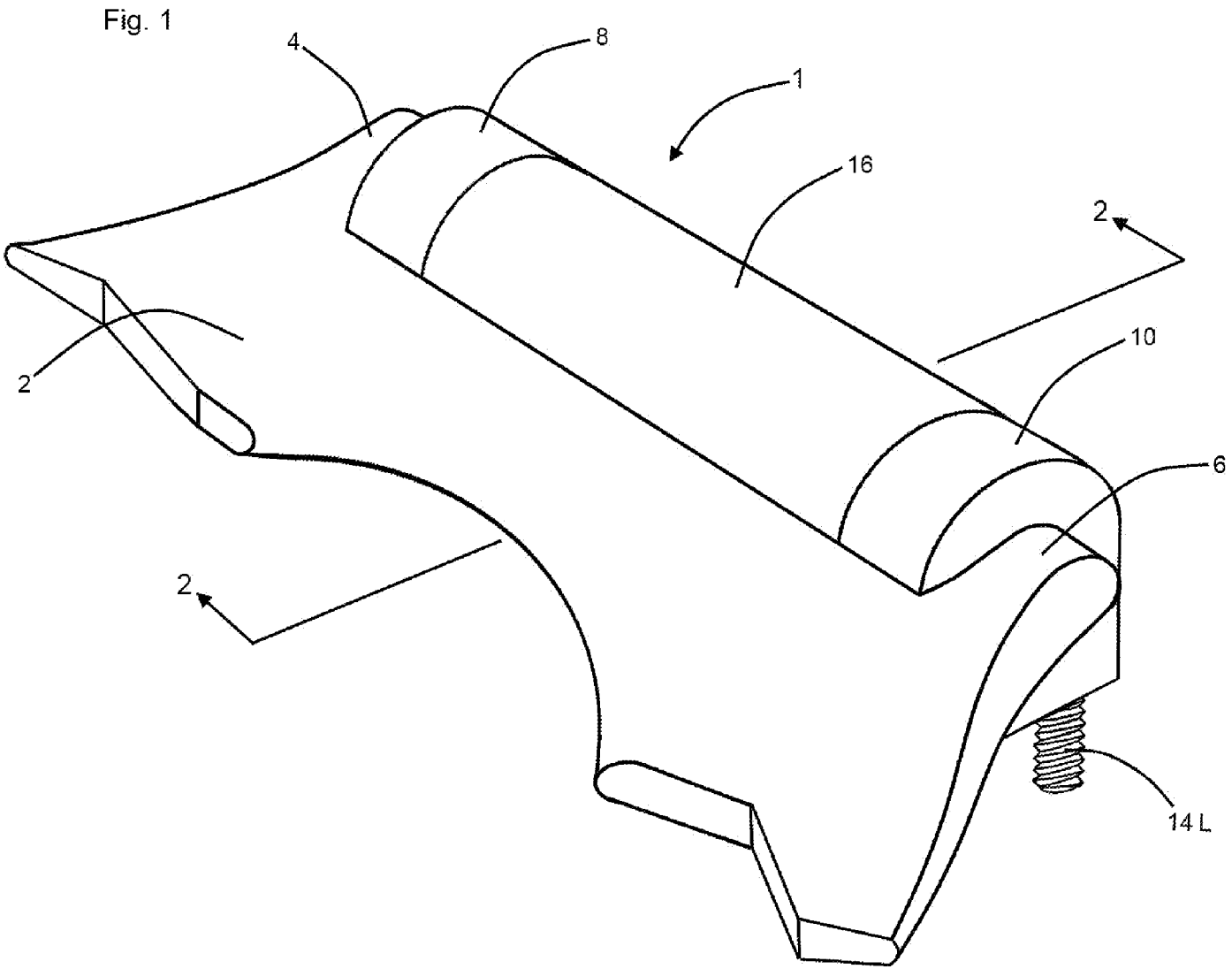
FIG. 1 is a perspective view of a preferred embodiment of the instant inventive assembly for pivotally lowering a raised toilet seat.
Figure 2:
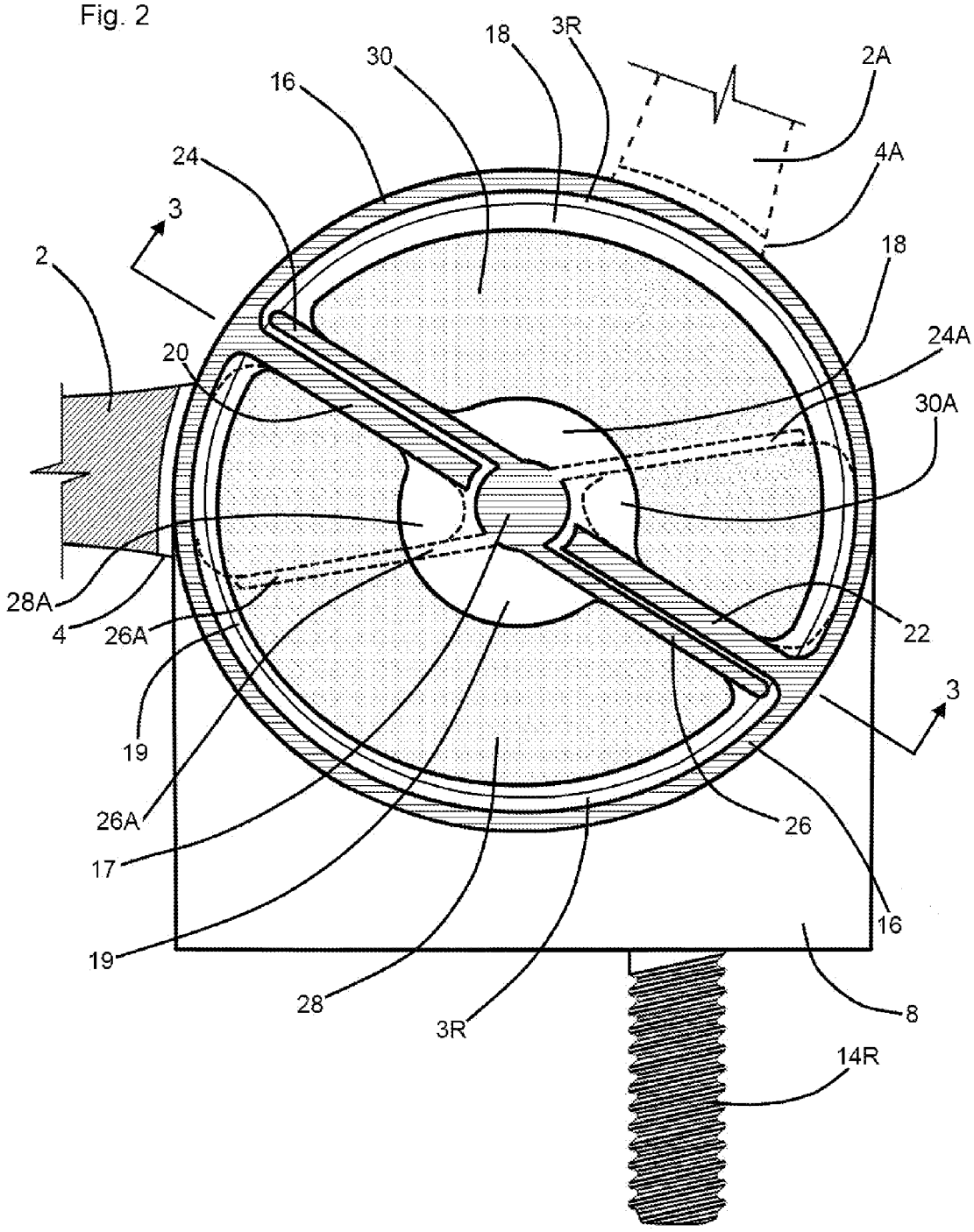
FIG. 2 is a sectional view as indicated in FIG. 1.
Figure 3:
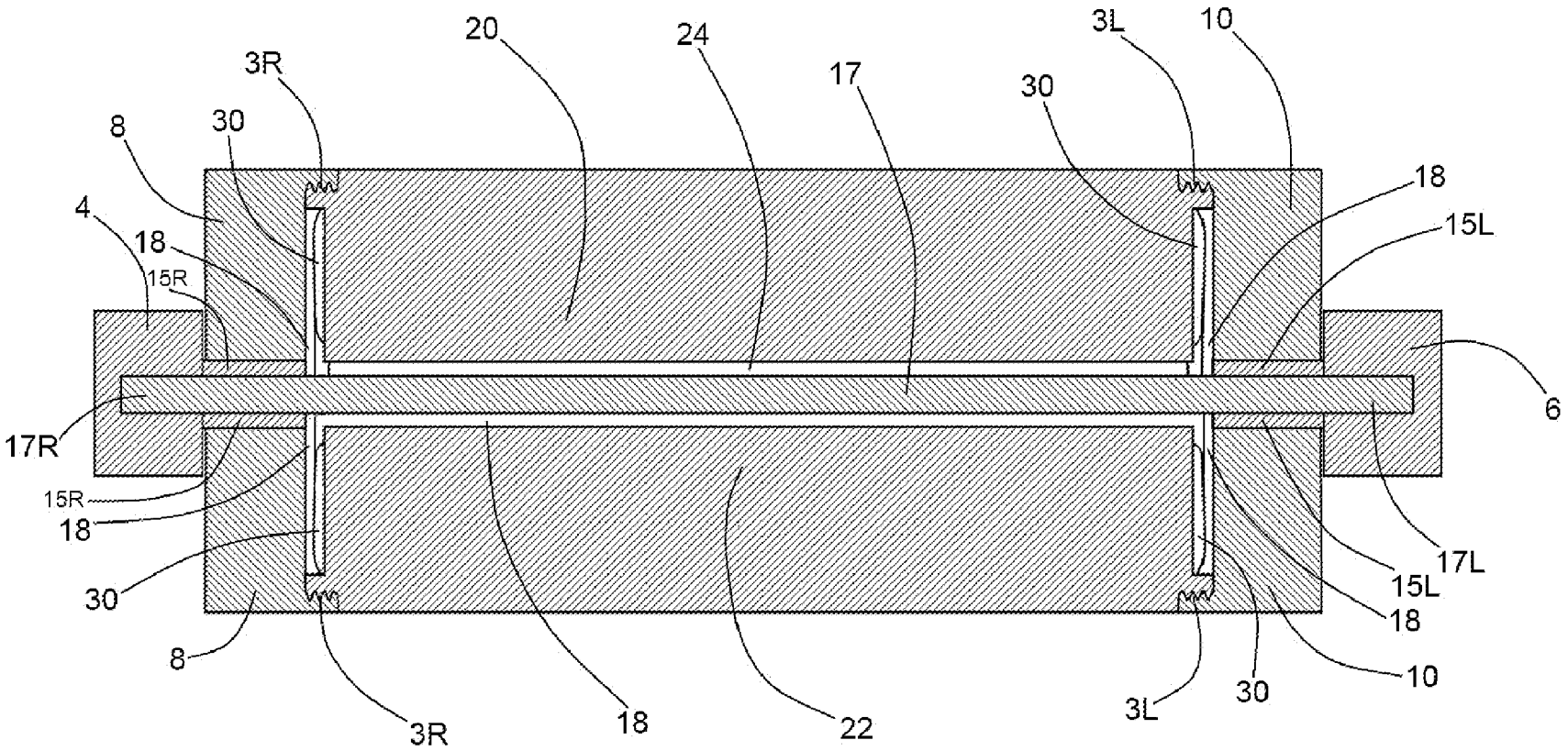
FIG. 3 is a sectional view as indicated in FIG. 2.

Referring now to the drawings, and in particular to FIGS. 1 and 2, a preferred embodiment of the inventive assembly for delayed lowering of a raised toilet seat is referred to generally by Reference Arrow 1. The assembly comprises a hollow chamber 18, 19, such chamber 18, 19 preferably having a cylindrical lateral cross-sectional profile and being circumferentially bounded and defined by a cylindrical wall 16. The hollow chamber 18, 19 is preferably bounded at its axial ends by right and left end walls 8 and 10, such walls dually functioning at toilet mount supports. Referring further simultaneously to FIG. 3, helically threaded joints 3R and 3L are suitably provided for releasably connecting the right and left end walls 8 and 10 to the axial ends of the cylinder 16, such helically threaded joints 3R and 3L preferably substantially hermetically sealing the hollow chamber 18, 19 against any inward passage of moisture. Permanent adhesively bonded joints may be suitably substituted for the helically threaded joints 3R and 3L. Alternatively, other commonly known joint configurations such as welded joints, compression fitted joints, wholly formed joints, or snap fastening joints may be suitably substituted for the helically threaded joints 3R and 3L.

Referring simultaneously to FIGS. 2 and 3, a pair of compression walls which are configured as flanges 20 and 22 are received and positioned within the chamber 18, 19, such flanges suitably extending radially inwardly into the chamber 18, 19 from the chamber's wall 16. Such flanges 20 and 22 effectively partition the chamber into the depicted pair of semi-cylindrical foam compression and expansion spaces 18 and 19. Suitably, the compression walls may be alternatively configured as bars or plates which extend axially along the axial lengths of the chambers 18 and 19, the left and right ends of such bars or plates being anchored at the right and left end walls 8 and 6.

Referring to FIG. 2, at least a first, and preferably first and second compression plates 24 and 26 are provided. According to a preferred configuration of the instant invention, the first and second compression plates 24 and 26 are pivotally movable between an expanded foam position which is represented by FIG. 2's solid line depictions of the compression plates 24 and 26, and a foam compressing position represented by alternate reference numerals 24A and 26A and represented by the alternately positioned dashed line depictions of such compression plates.

Referring further to FIG. 2, the instant inventive assembly preferably further comprises at least a first, and preferably first and second pieces of alternatively compressible and expandable viscoelastic polyurethane foam, foam piece 28 being received within chamber section 19 and foam piece 30 being received within chamber section 18. Referring further to FIG. 3, upon unscrewing and removing end wall 8 or end wall 10 from cylinder 16 through manipulation of threaded joints 3R or 3L, the foam pieces 28 and 30 may be easily and conveniently inserted into or removed from their respective chambers 19 and 18. Upon foam piece insertion, and reassembly, the helical threads of such joints 3R and 3L advantageously create hermetic seals which resist any inward seepage of elastic foam fouling moisture. The viscoelastic foam pieces 28 and 30 are preferably semi-cylindrical in shape, and as is shown in FIG. 3, they preferably have an axial length substantially spanning the entire interior axial dimensions of the chambers 17 and 18. The foam pieces 28 and 30 are also preferably respectively radially positioned between the foam compression walls 20 and 22 and the compression plates 26 and 24.

Referring simultaneously to all figures, a further structural component of the instant inventive assembly for pivotally lowering a raised toilet seat comprises linking means which operatively interconnect a toilet seat 2 and at least a first compression plate 24 or 26, such means preferably operatively interconnecting both such plates 24 and 26. The linking means are preferably adapted for, upon moving the seat 2 to its 2A position depicted in FIG. 2, rotatably or orbitally moving the compression plates 24 and 26 to their foam compressing positions 24A and 26A. Upon such seat movement motion, the pieces of viscoelastic polyurethane foam 28 and 30 are compressed by the plates 26 and 24 from the expanded configurations 28 and 30 which are shown in solid lines upon FIG. 2 to their dashed line compressed configurations 28A and 30A.

The linking means components of the instant inventive assembly are preferably further adapted for, upon the foam pieces' 28A and 30A's subsequent expansions from their dashed line represented compressed configurations toward their solid line represented expanded configurations 28 and 30, oppositely moving and orbitally carrying the compression plates 26A and 24A toward their expanded foam positions 26 and 24. Such induced opposite orbiting motion of the compression plates 26 and 24 advantageously lowers the seat 2 from the raised 2A position shown in dashed lines to the lowered solid line position 2.

Referring further simultaneously to all figures, the linking means preferably further comprise an axle 17 having a leftward extension 17L protruding leftwardly from the left wall 10 and having a rightward extension 17R protruding rightwardly from the right wall 8. Bearings 15L and 15R mounted within the walls 10 and 8 rotatably receive and support the left and right ends 17L and 17R of the axle 17.

Referring further simultaneously to all figures, the linking means preferably further comprise fixed and rigid attachments of the compression plates 24 and 26 and the seat 2 to the axle 17. The seat 2 is preferably configured to include right and left clevis arms 4 and 6 which respectively receive the right and left ends 17R and 17L of the axle 17. The clevis joint which is formed by the combination of the seat 2 and the arms 4 and 6 is preferably closely form fitted for receiving the circumferentially and axially extending dimensions of the cylinder 16 and its end walls 8 and 10, such close fitting eliminating pinch points and minimizing debris accumulating crevice surfaces. Similarly with the clevis arms' 4 and 6's rigid attachments to the axle's right and left ends 17R and 17L, the compression plates 24 and 26 are rigidly attached to the medial portion of the axle 17. The radially proximal or inner ends of such plates 24 and 26 are preferably fixedly attached to or formed wholly with the axle 17.

Referring further simultaneously to all figures, where the linking means comprise the rigid attachments of seat, plate, and axle structures as described above, the seat 2, its clevis arms 4 and 6, the axle 17, and the attached compression plates 24 and 26 are able to pivotally move in unison with respect to the assembly's fixed components, including the cylinder 16, the cylinder's compression flanges 20 and 22 and the end walls 8 and 10, from the solid line positions 2, 24, and 26 shown in FIG. 2 to the alternative dashed line positions 2A, 24A, and 26A also shown in FIG. 2. Conventional right and left helically threaded lugs 14R and 14L preferably extend downwardly from and are fixedly attached to the right and left end walls 8 and 10 for extension into and engagement within a toilet's conventional seat mounting apertures.

The linking means depicted in FIGS. 1-3 are representative and exemplary, and other hinge associated structural combinations capable of mechanically translating at the site of a toilet seat's hinge the pivoting motion of the toilet seat into alternative compressing and rarefying motions of the at least first piece of viscoelastic polyurethane foam are considered to fall within the intended scope of such means and of the instant invention. An example of such other hinge associated structural combinations is one wherein the cylinder is fixedly attached to the seat, wherein the moveable compression plate is mounted upon and moves with the seat and cylinder, and wherein the cylinder's wall or flange are fixed and immovable within the cylinder via attachment to a fixed axle. In other examples, the chamber within which the viscoelastic polyurethane foam is compressed and expanded is situated leftwardly or rightwardly from the toilet seat's hinges.

In use of the inventive assembly for delayed lowering of a raised toilet seat 1, a user may initially grasp the assembly and may align the lower ends of helically threaded lugs 14R and 14L over exposed toilet seat mounting apertures (not depicted within views) of a toilet upon which the assembly is to be installed. Thereafter, the user may downwardly extend such lugs 14R and 14L into such apertures, and the user may secure such lugs, along with the entire assembly 1, upon such toilet through turning installations of matching helically threaded nuts (also not depicted within views) which underlie the toilet's rim. Thereafter, such user may grasp a forward end of the toilet seat 2 and may pivotally upwardly raise the toilet seat 2. Such pivotal raising motion simultaneously rotates axle 17 clockwise according to the perspective of FIG. 2 within rotary bearings 15R and 15L within the cylinder's right and left end walls 8 and 10. Such induced rotary motion of the seat 2 and the axle 17 simultaneously pivotally moves the compression plates 24 and 26 in the clockwise direction from their expanded foam positions which are depicted in solid lines upon FIG. 2 toward their dashed line depicted foam compression positions 24A and 26A. Upon the clockwise pivoting motions of such structures, the two semi-cylindrical pieces of viscoelastic polyurethane foam 28 and 30 respectively become compressed between the compression plates 24 and 26 and the cylinder's compression flanges 22 and 20 to assume their compressed configurations 30A and 28A.

According to the conventionally known character of the viscoelastic polyurethane composition of the foam pieces 28A and 30A, such foam pieces upon their depicted compression tend to slowly rebound to or elastically recover their original "memory" configurations 28 and 30. Such slow recovery characteristic is advantageously mechanically translated into a similarly slow counter-clockwise counter-pivoting movement of the compression plates 24 and 26, of the axle 17, and of the toilet seat 2. Such slowed viscoelastic polyurethane foam impelled counter-pivoting movement advantageously allows male operators of the inventive assembly to commence and complete a usage of the toilet prior to the foam impelled seat closing motion. In order to prevent any undesirable accelerated and pivotal falling motion of the toilet seat during such viscoelastic polyurethane foam impelled seat lowering motion, the rotary bearings 15R and 15L are preferably of the type which may exert a slight frictional rotation resisting force upon the axle ends 17R and 17L.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An assembly for delayed movement of a toilet seat to a lowered position, said assembly comprising:

(a) a chamber;

(b) at least a first foam compression wall within the chamber;

(c) at least a first compression plate within the chamber, the at least first compression plate being movable between a foam compressing position and an expanded foam position;

(d) at least a first piece of alternatively compressible and expandable viscoelastic polyurethane foam within the chamber, the at least first foam piece being positioned between the at least first compression plate and the at least first foam compression wall; and (d) linking means operatively interconnecting the toilet seat and the at least first compression plate, the linking means being adapted for alternatively moving the at least first compression plate to the foam compressing position upon moving the toilet seat to a raised position, and being adapted for, upon said at least first foam piece's expansion, counter-moving the at least first compression plate to its expanded foam position and moving the toilet seat to the lowered position.

2. The assembly of claim 1 wherein the linking means comprise an axle extending through the chamber.

3. The assembly of claim 2 wherein the chamber is cylindrical, and wherein the chamber's at least first foam compression wall comprises a flange.

4. The assembly of claim 3 wherein the at least first compression plate is fixedly attached to and extends radially outwardly from the axle.

5. The assembly of claim 4 further comprising a second foam compression wall, a second compression plate, and second piece of viscoelastic polyurethane foam, said wall, plate and foam piece being operatively mounted within the cylindrical chamber.

6. The assembly of claim 5 wherein the second foam compression wall comprises a second flange.

7. The assembly of claim 6 wherein the second compression plate is fixedly attached to and extends radially outwardly from the axle, and wherein the second piece of viscoelastic polyurethane foam is received between the second radially inwardly extending flange and the second compression plate.

8. The assembly of claim 7 further comprising operatively connected toilet attaching means.

9. The assembly of claim 8 wherein the axle has left and right ends, wherein the cylindrical chamber has left and right ends, wherein the axle's left and right ends respectively extend leftwardly and rightwardly from the chamber's left and right ends, and wherein the seat is fixedly attached to the axle's left and right ends.

10. The assembly of claim 9 further comprising left and right axle bearings, the leftward and rightward extensions of the axle's left and right ends being respectively received within the left and right axle bearings.

11. The assembly of claim 10 wherein the cylindrical chamber comprises closing means for, upon inserting the at least first and second pieces of viscoelastic polyurethane foam into the cylindrical chamber, hermetically sealing the cylindrical chamber.

12. The assembly of claim 11 wherein the chamber's left and right ends respectively comprise left and right end walls, and wherein the toilet attaching means comprise left and right helically threaded lugs respectively fixedly attached to and extending downwardly from the cylindrical chamber's left and right end walls.

13. The assembly of claim 12 wherein the cylindrical chamber has an annular outer surface, and wherein the toilet seat's fixed attachment to the axle's left and right ends comprises a clevis joint.

14. The assembly of claim 13 wherein the clevis joint is closely fitted to the cylindrical chamber for orbital motion about the cylindrical chamber's annular outer surface.

* * * * *